US007669374B2

(12) United States Patent
Miller et al.

(10) Patent No.: US 7,669,374 B2
(45) Date of Patent: Mar. 2, 2010

(54) BEAM FOR A DRYWALL CEILING SOFFIT

(75) Inventors: Donald C. Miller, Elkton, MD (US); William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 153 days.

(21) Appl. No.: 11/732,592

(22) Filed: Apr. 3, 2007

(65) Prior Publication Data

US 2008/0245018 A1 Oct. 9, 2008

(51) Int. Cl.
*E04B 9/00* (2006.01)

(52) U.S. Cl. ..... 52/506.07; 52/506.06; 52/665; 52/733.1

(58) Field of Classification Search ..... 52/733.1, 52/664, 506.06, 506.07, 656.1, 665, 668
See application file for complete search history.

(56) References Cited

U.S. PATENT DOCUMENTS

| | | | | |
|---|---|---|---|---|
| 4,106,878 | A * | 8/1978 | Jones | 403/28 |
| 4,128,978 | A * | 12/1978 | Beynon | 52/232 |
| 4,598,514 | A * | 7/1986 | Shirey | 52/232 |
| RE33,501 | E * | 12/1990 | Platt et al. | 52/664 |
| 6,351,919 | B1 * | 3/2002 | Lin et al. | 52/506.07 |
| 6,722,098 | B2 | 4/2004 | Platt | |
| 6,751,922 | B1 * | 6/2004 | Auriemma | 52/506.05 |
| 6,957,517 | B2 * | 10/2005 | Auriemma | 52/506.07 |
| 2002/0050547 | A1 * | 5/2002 | Medlin et al. | 248/205.1 |

* cited by examiner

*Primary Examiner*—Richard E Chilcot, Jr.
*Assistant Examiner*—Anthony N Bartosik
(74) *Attorney, Agent, or Firm*—Eugene Chovanes

(57) ABSTRACT

A straight rollformed beam made for use in a suspended horizontal drywall ceiling is modified so that it can be used in a drywall ceiling underhang known as a drywall ceiling soffit. The beam is made with repetitive configurations along the length of the beam that are selectively cut, in the field, so that the beam can be bent to, and then fixed at, a desired angle. Drywall panels are secured to a plurality of such beams that form a framework for the soffit.

6 Claims, 7 Drawing Sheets

FIG. 5
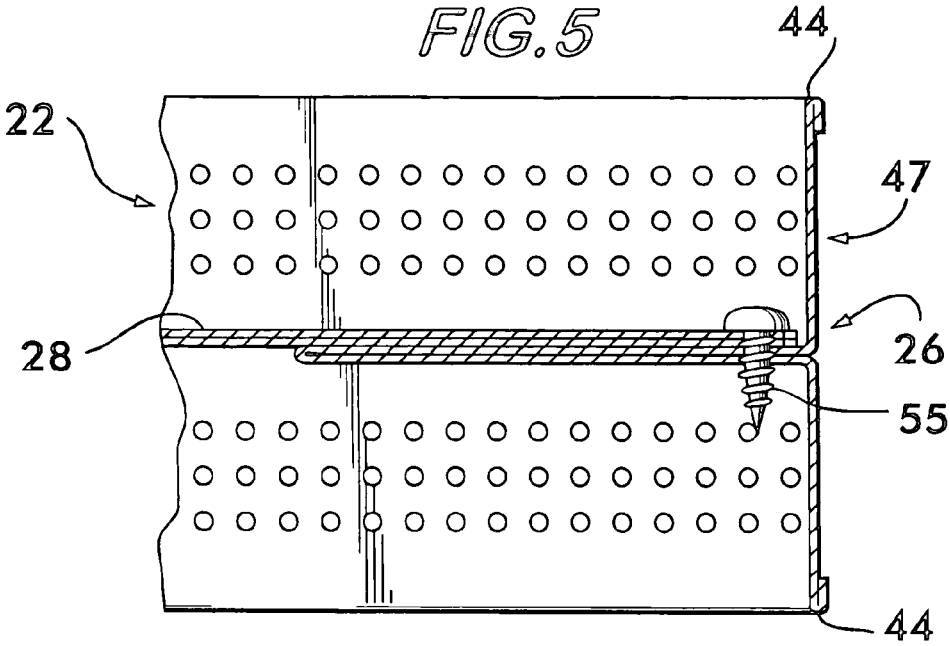
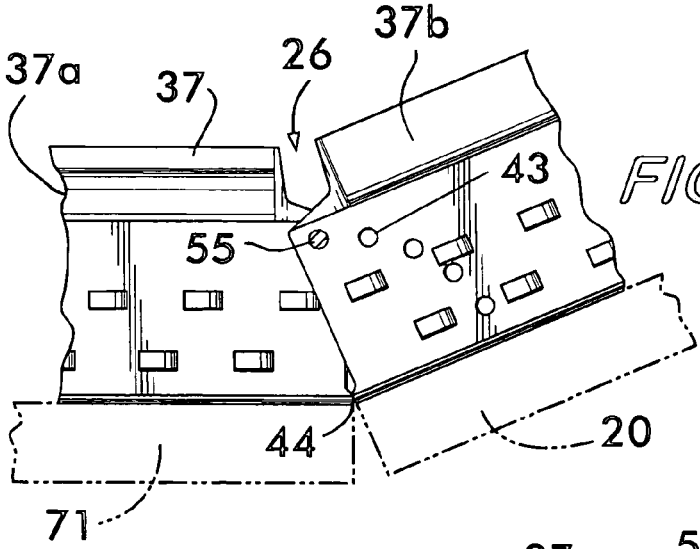
FIG. 6
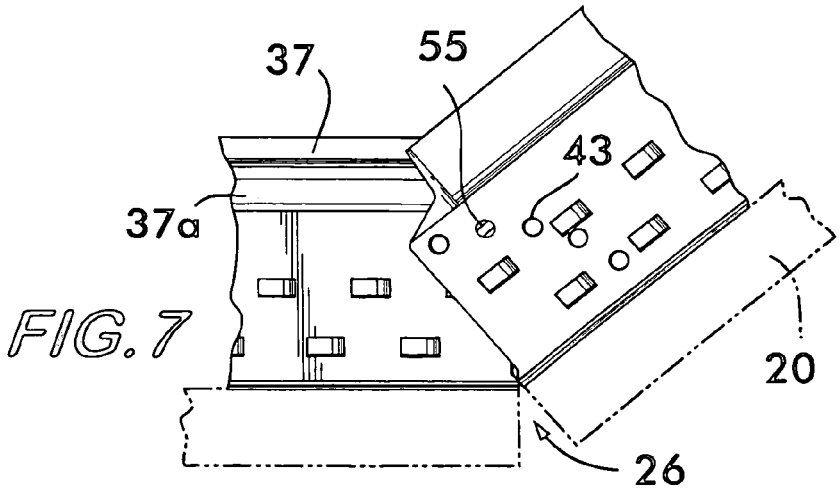
FIG. 7

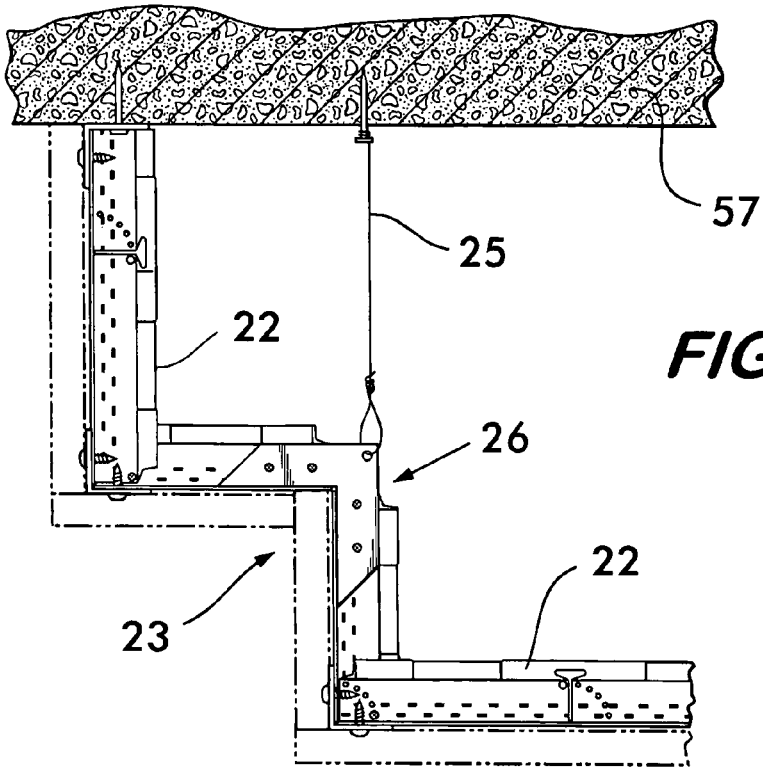
FIG.14
FIG.15
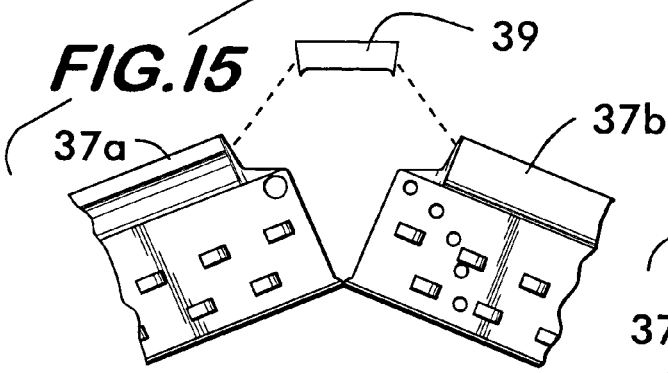
FIG.16
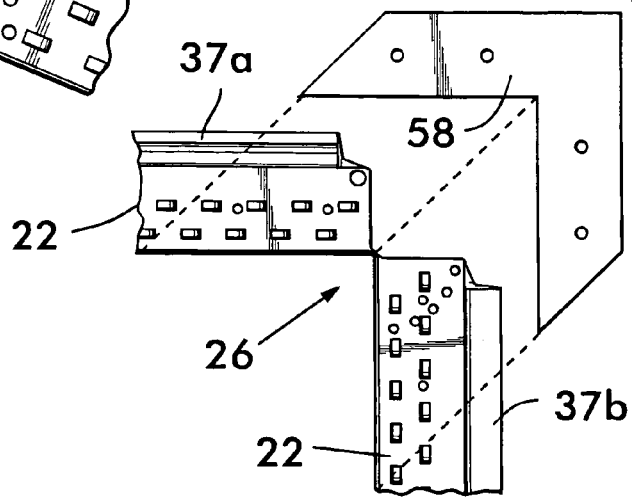

BEAM FOR A DRYWALL CEILING SOFFIT

BACKGROUND OF THE INVENTION (1) Field of the Invention

The invention relates to beams that support attached drywall sheets to form suspended drywall ceilings and ceiling soffits.

(2) Description of the Related Art

Beams used in suspended drywall ceilings are well known. In such ceilings, beams are suspended by hanger wires from a structural ceiling, and sheets of drywall are secured to the suspended beams by self-tapping screws.

The beams are made by continuously rollforming a strip of metal to fold the strip longitudinally into an inverted T cross section, with a bulb at the top, a web extending down from the bulb, and two flanges extending horizontally opposite from one another at the lower end of the web. The flanges have indentations over their lower surface that capture self-tapping screws to permit the screws to penetrate the flange after passing through the drywall sheet.

Such a beam is shown, for instance, in U.S. Pat. No. 6,722,098, for Beam for Drywall Ceiling, incorporated herein by reference.

Suspended drywall ceilings generally extend horizontally. Occasionally, a ceiling soffit in the form of an underhang, having a two dimensional cross-section, is formed. The drywall ceiling soffit is made with the same kind of beams and drywall sheets used in a horizontal drywall suspended ceiling. In forming the soffit, straight beams of the kind used in such horizontal drywall suspended ceiling are individually cut and bent in the field, and fastened together by drilling holes and inserting fastening screws. A plurality of bent beams is used to form a beam framework for the soffit.

Such work in the field is time-consuming, and often non-uniform, so that the parts do not fit well together.

BRIEF SUMMARY OF THE INVENTION

As a straight beam such as shown, for instance, in the '098 patent, is being continuously rollformed and cut into 10 ft. or 12 ft. lengths, the beam is repetitively identically configured at 6" to 8" intervals along the beam. The beam, even as configured, remains straight, intact, and strong enough to be shipped to, and handled at, a job site without distortion.

At the job site, the configurations are selectively adapted to create uniform and strong bends in a beam that is then used, with similarly formed beams, to create a framework for a drywall soffit.

In the configuration, a T-shaped hole is stamped in the bulb and web, with a link remaining in the bulb above the hole. The link keeps the beam intact.

In the configuration, a segment of the bulb is flattened on both sides of the link. Optionally, the flattened segment on one side of the link is stiffened by a depressed channel that extends along the segment. A score is formed, in the configuration, in each flange of the beam at the location intended to be bent.

Holes for screws are spaced in the web of the configuration.

In the field, at a selected configuration where a bend in the beam is desired, the link is cut out. The beam is then bent to a desired angle, and fixed at the desired angle by matching the screw holes in the configuration, and tapping a screw through the matching holes.

A plurality of similarly bent and fixed beams is used to create a framework for the ceiling soffit.

The invention permits beams to be rapidly and uniformly bent, and fixed, to form a desired angle, in the field, to create a framework for a ceiling soffit.

BRIEF DESCRIPTION OF SEVERAL VIEWS OF THE DRAWINGS

FIG. 5 is a sectional view taken on the 5-5 in FIG. 4.

FIGS. 6 through 9 are similar side-elevational views showing the beam bent to various different angles.

FIG. 6 shows a beam bent to a 15° angle.

FIG. 7 shows a beam bent to a 30° angle.

FIG. 8 shows a beam bent to a 45° angle.

FIG. 9 shows a beam bent to a 60° angle.

FIG. 14 is a cross-sectional view of a ceiling soffit in step form, having a bend at a reflex angle of 270°.

FIG. 15 is a side elevation showing a beam of the invention with the link cut out of a configuration, and the beam being bent to the angle shown in FIG. 14.

FIG. 16 is a view of the beam bent to the angle shown in FIG. 14, with the brace used to fix the angle exploded from the assembled angle.

DETAILED DESCRIPTION OF THE INVENTION

The invention will be disclosed as applied to the beam in the '098 patent, although the invention is suited for other prior art rollformed beams that support ceiling drywall.

Figures 1, 2:
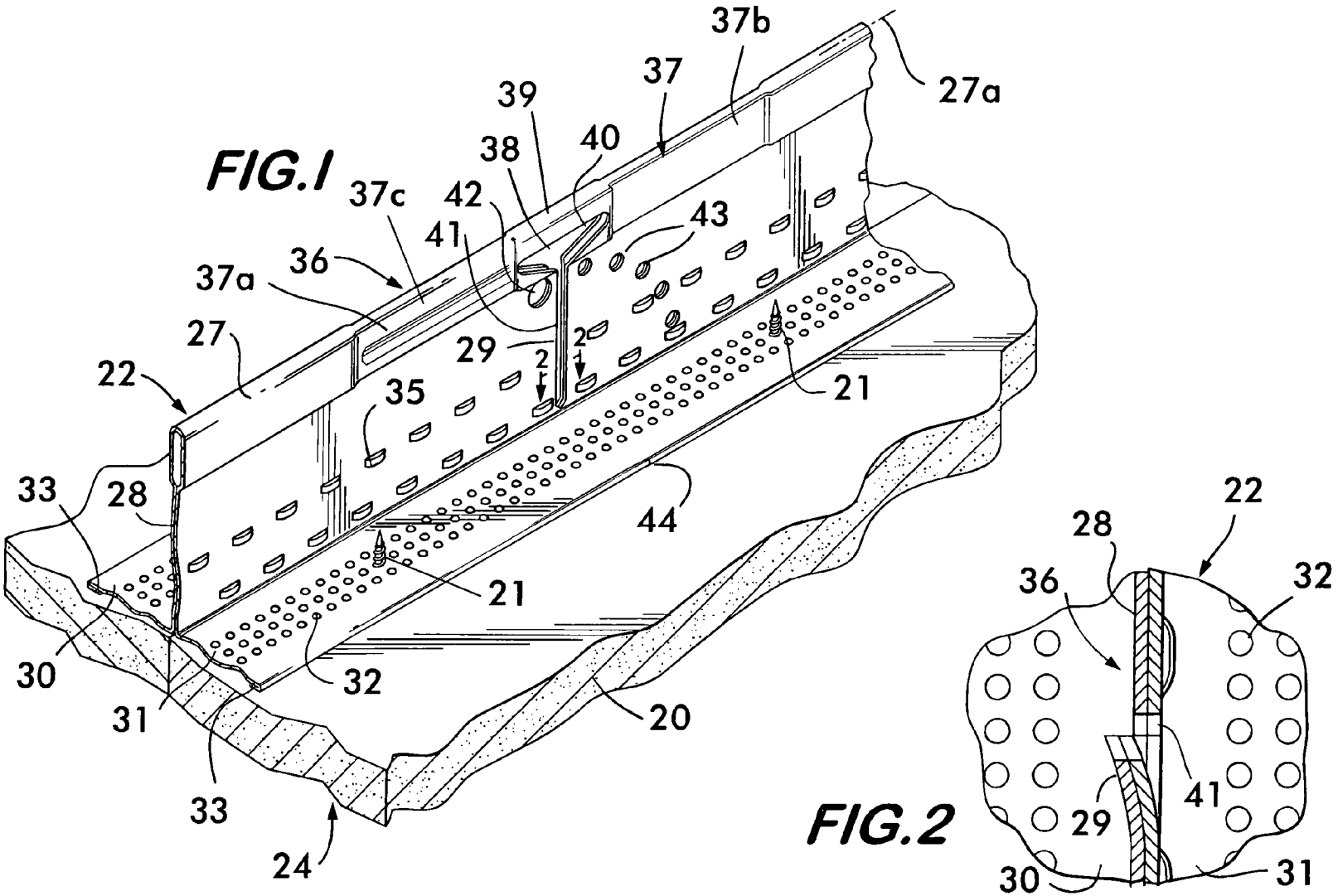
FIG. 1 is a perspective view taken from above, of a configuration in an unbent beam of the invention, shown supporting drywall in a horizontal segment of a suspended drywall ceiling or ceiling soffit.
FIG. 2 is a cross-sectional view taken on the line 2-2 in FIG. 1.

As seen particularly in FIG. 1, drywall 20, in sheet form, is affixed by self-tapping screws 21 to beam 22 in a framework of beams that support the drywall 20, to form a horizontal suspended drywall ceiling 24. In a horizontal suspended drywall ceiling 24, such beams 22 are interlocked into a grid supported from a structural ceiling by hanger wires.

Figure 10:
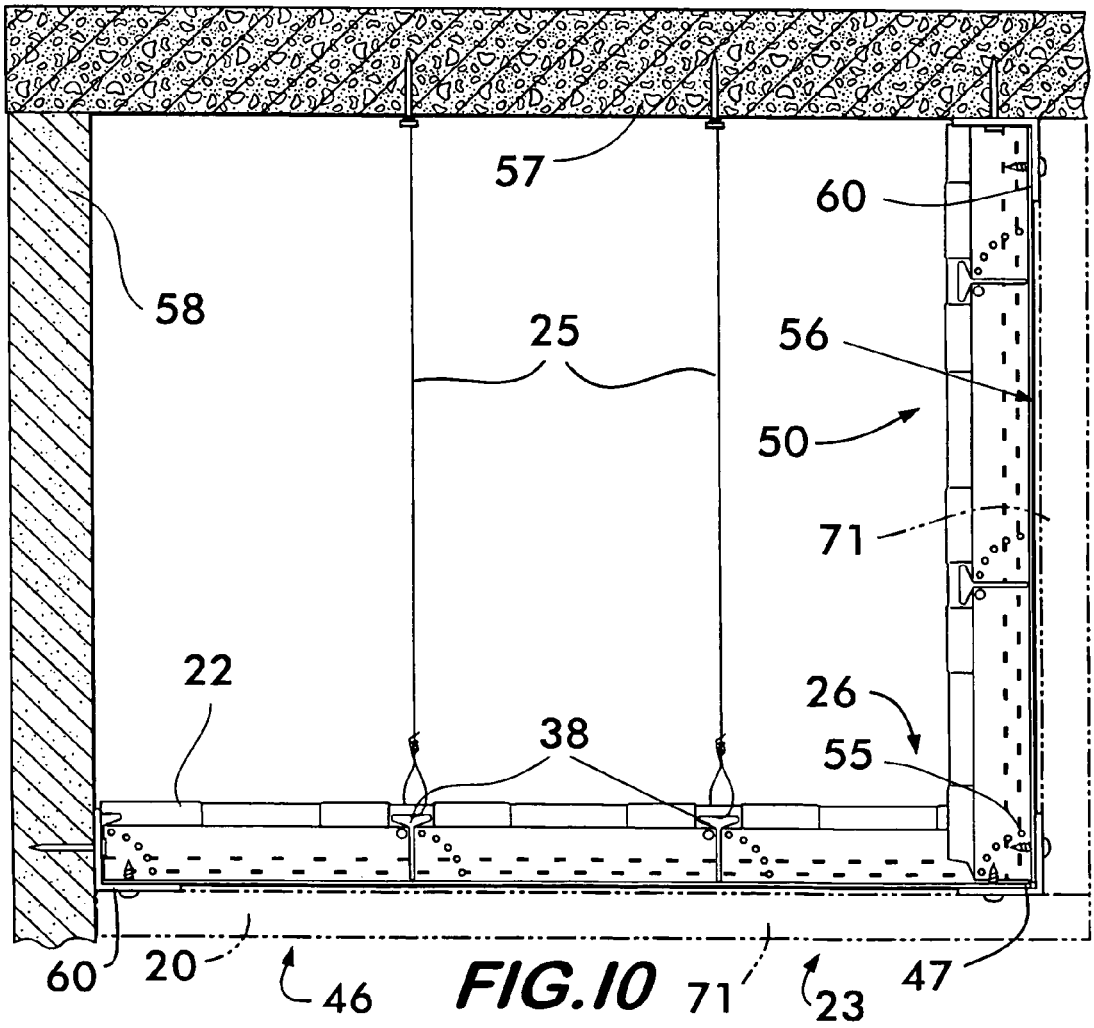
FIG. 10 is a cross-sectional view of a ceiling soffit, formed below a structural ceiling and against a wall, with the beams of the invention.
Figure 11:
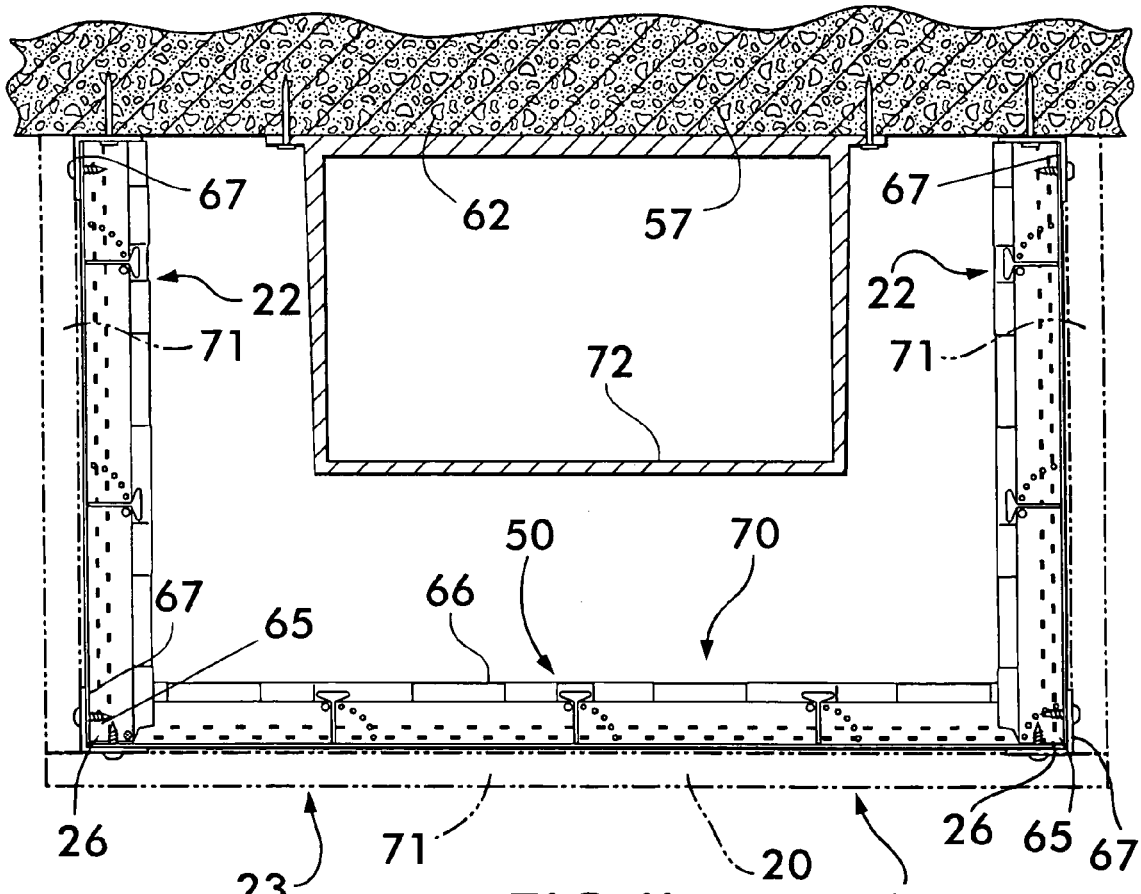
FIG. 11 is a cross-sectional view of a ceiling soffit enclosing duct work, formed below a structural ceiling, with the beams of the invention.

In some instances, a plurality of beams 22 is used to form a framework for a ceiling soffit 23. Examples of such ceiling soffits 23 are seen in FIGS. 10, 11, and 14 wherein the framework of beams 22 is suspended by hanger wires 25, as seen in FIGS. 10 and 14, or by the beams 22 themselves, as seen in FIG. 11.

The present invention is concerned with the bends 26 in the beams 22 that are necessary in forming the ceiling soffit 23. A horizontal suspended drywall ceiling does not use any such bends.

As seen in FIG. 1, wherein the invention is illustrated with the beam of the '098 patent, beam 22 is in the form of an inverted T, with a bulb 27 at the top, a web 28 extending downwardly from the bulb 27, and outwardly opposite extending flanges 30 and 31 at the bottom of the web 28. Upward indentations 32 extend over the bottom of the flanges 30 and 31 of the T beam 22.

A hem 33 extends along the edge of each flange 30 and 31. The hem 33 is formed by folding the metal edge downward and inward against the bottom of the flange while the beam 22 is being rollformed.

Stitches 35, or another form of fastening, such as welding, secure the two layers of web 28 together to give a rigidity to the beams 22.

The present invention involves, while the beam 22 is being formed and cut into 10 ft. or 12 ft. lengths, creating, at 6" or 8" intervals along the beam 22, a configuration 36 in the beam 22 that keeps the beam intact, and does not materially weaken the beam 22. Such beam 22 can be used as a straight beam where a configuration 36 is left intact, but the beam 22, at a selected configuration 36, can be bent and fixed at such bend, simply and accurately, at the job site, and used in a ceiling soffit framework.

In a configuration 36 of invention, as seen in FIG. 1, a T-shaped portion is stamped out of the beam 22 to form hole 38, and link 39 in the bulb 27 above the hole 38. Segments 37*a* and 37*b* of the bulb 27 on each side of the link 39 are flattened symmetrically along the longitudinal center line 27*a* of the bulb 27. Each of these segments may be, for instance, 1¼" long, with the link extending a distance of ¾". A stiffener 37*c* in the form of a depressed channel is optionally formed in segment 37*a*, in a direction, as shown, that will not interfere with the subsequent bend. A clearance hole 42 and angle pilot holes 43, spaced radially, are punched in the web 28.

A bending score 44, is formed in the hem 23 at the edge of each flange 30 and 31, transversely to the beam 22 length. Such bending score 44 extends inwardly for, for instance, ⅛" and retains the bend at the score 44.

Web 28 is offset at 29 as seen in FIG. 2, so, when the beam is bent, the web beneath bulb segment 37*b*, and bulb segment 37*b*, are forced off-center, so there is no interference with bulb segment 37*a*, and the web beneath segment 37*a*, both of which remain centered, particularly when stiffener 37*c* is formed in segment 37*a*.

The beams 22 are produced at the factory site in 10 ft. or 12 ft. lengths, as set forth above and shipped to the job site. The beams 22 remain strong enough at the configurations to endure such shipment without damage, and remain intact. At the job site, a framework 50 of the beams 22 is created to be used, for instance, in the ceiling soffit 46 of FIG. 10. In such ceiling soffit 46 of FIG. 10, the beams 22 are bent and fixed at a 90° angle at bend 47.

In selecting the configuration to form the bend 47, at the job site, the total vertical and horizontal length of a beam in the framework 50 of soffit 46 is determined and the beam 22 cut to such length. The bend 47 is then made at a selected configuration 36 in the beam that provides the desired bent shape to the beam 22. The link 39 in the remaining configurations 36 remains uncut, so that the beam remains straight and intact and strong enough to support the drywall.

Figure 3:
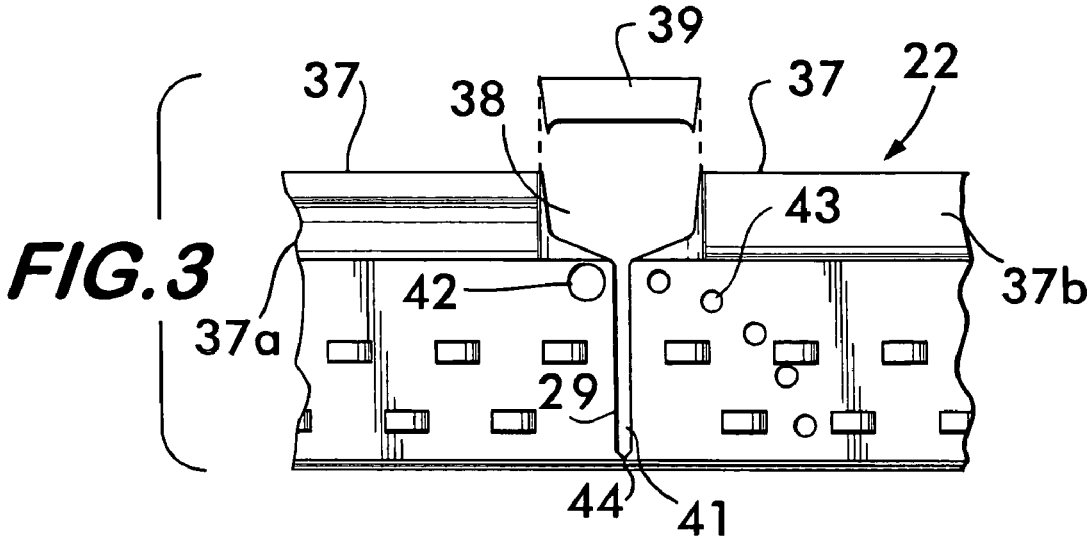
FIG. 3 is a side elevation of the beam of the invention showing the beam with a link cut out prior to bending the beam.
Figure 4:
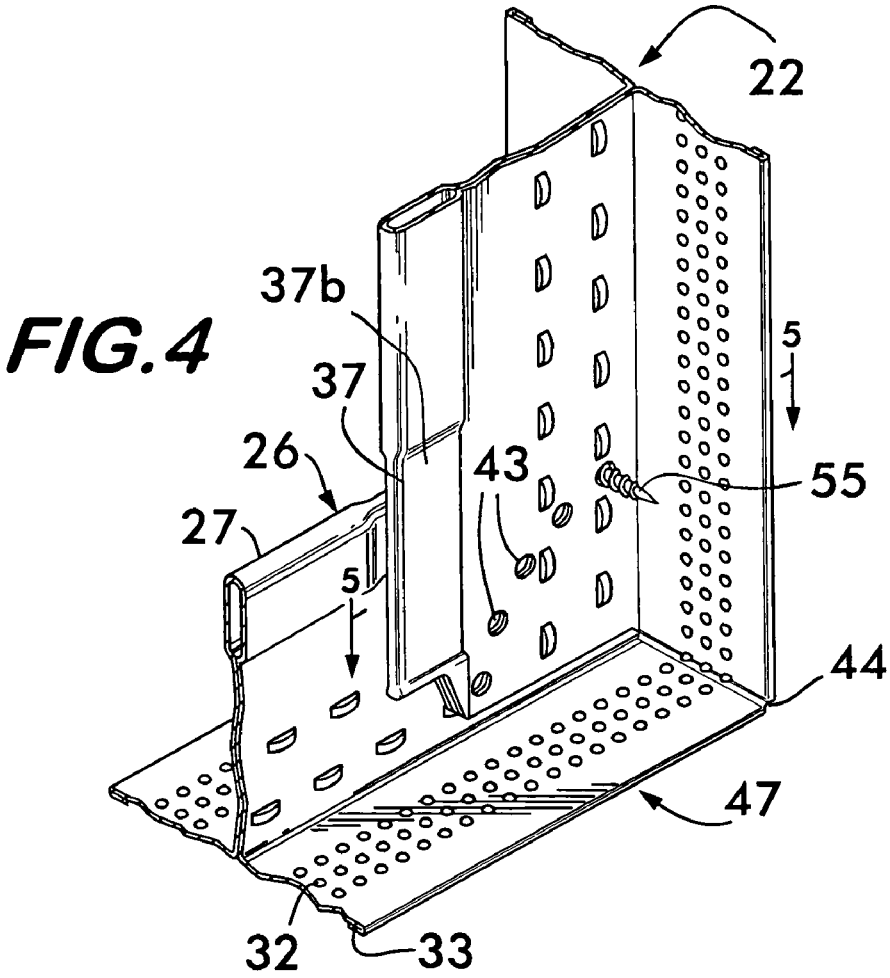
FIG. 4 is a perspective view of the beam bent at a 90° angle, and the bend fixed with a self-tapping screw.
Figure 9:
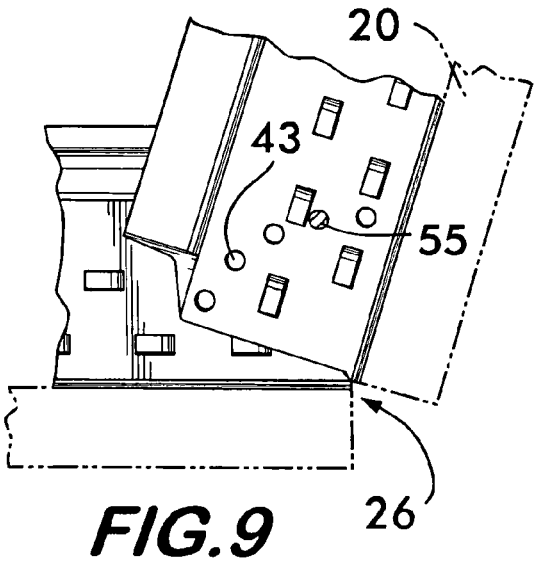
Figure 8:
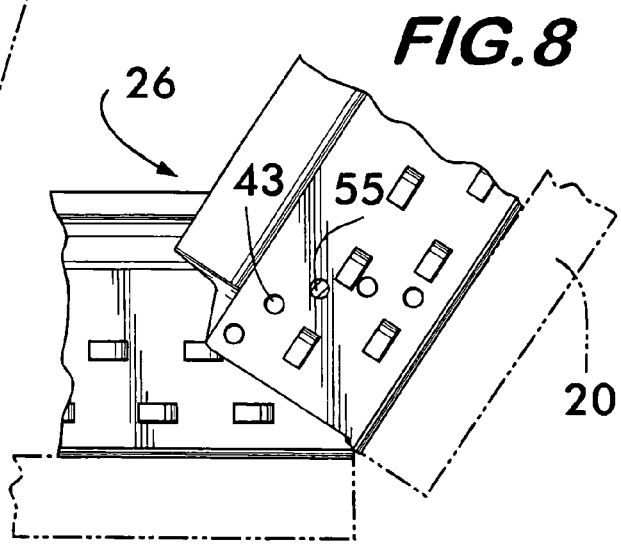

To form bend 47, the link 39 is snipped out of the flattened bulb 37 by making two vertical cuts about ¼" apart with hand shears, at the ends of the link 39, as seen in FIG. 3. The link 39 is that portion of the bulb 37 that extends above the horizontal top 40 of the hole 38, and is unflattened. The beam 22 is then bent through the various angles as shown in FIGS. 6 through 9 until, for example, a desired angle of 90° is formed, as shown in FIG. 4. The flattened bulb segment 37*b*, and web beneath the segment 37*b* yield slightly under the bias of offset 29, and slide alongside bulb segment 37*a*, under the bias of offset 29, so interference of the flattened bulb 37*a* and 37*b* segments, as well as the web portions, that overlap in making bend 47, is avoided. Stiffener 37*c*, when optionally used, further reinforces segment 37*a* so that it stays centered during the bend. A #6 framing screw 55 is tapped through the clearance hole 42 and the corresponding 90° angle pilot hole 43 to fix the bend 47 as shown in FIGS. 4 and 5.

The bent beam 56, as shown in FIG. 10, is then suitably supported from a structural ceiling 57 and wall 58, as by hanger wires 25 and angles 60, along with identical bent beams 56, that form a framework for the drywall 71 secured to the beams by self-tapping screws 55.

In FIG. 11, a ceiling soffit 61 is shown which is suspended solely from a structural ceiling 62. Again, a straight beam 22 is bent at a desirable location 65 to form a bent beam 66 that, along with other identically formed bent beams 66, is fixed to the ceiling 62 by suitable means, such as angles 67. Angles 67 may also reinforce the edges of the ceiling soffit 61.

Drywall 71 is affixed to the beam framework 70 by self-tapping screws 21 to finish the ceiling soffit 61.

As seen in FIG. 11, the ceiling soffit 61 is shown being used to enclose air duct 72.

Figures 12, 13:
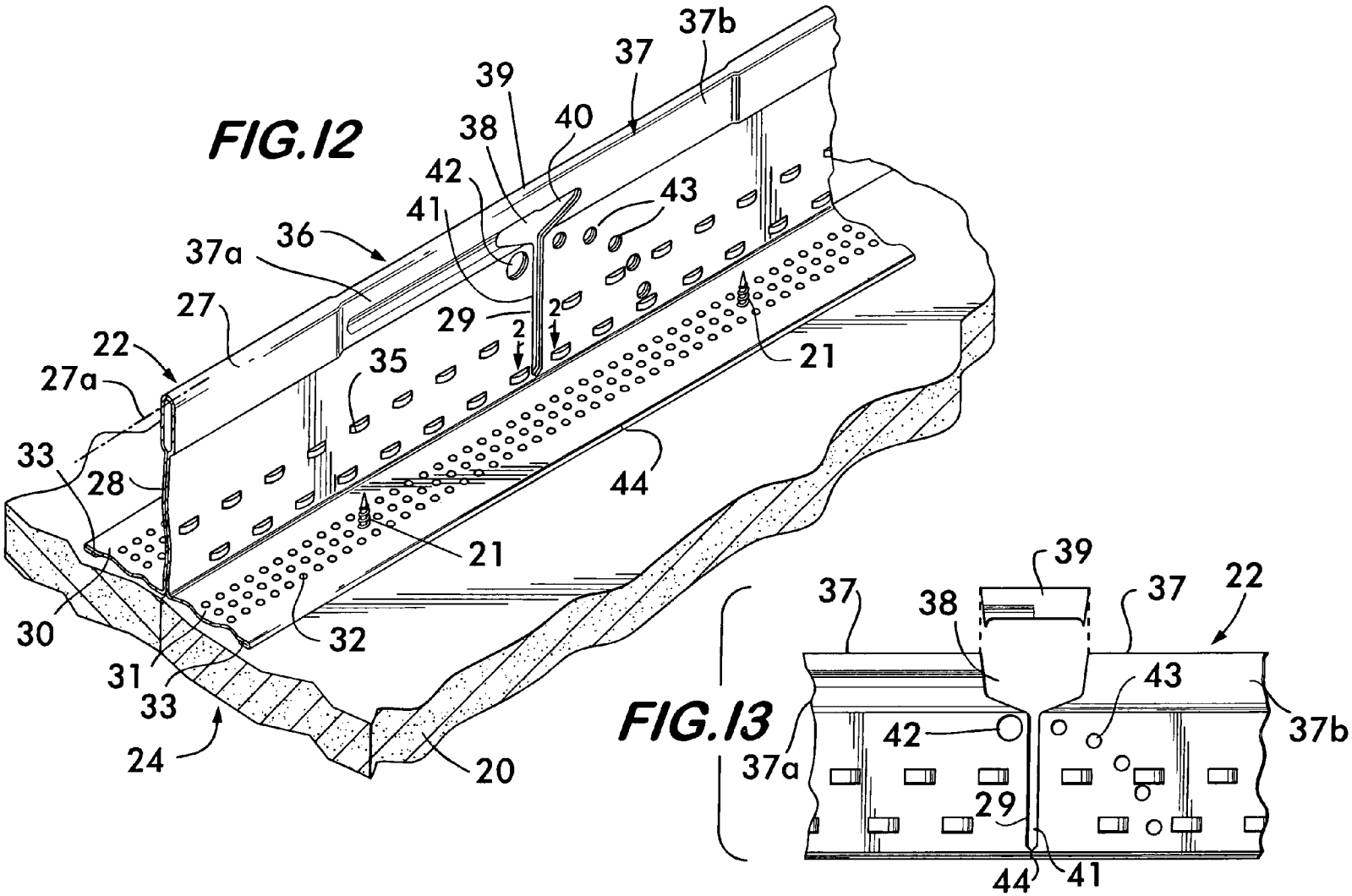
FIG. 12 is perspective view similar to FIG. 1 showing an alternative form of configuration in which the link is flattened.
FIG. 13 is a side elevation of the beam of FIG. 12, showing the link cut out of the beam.

In FIG. 12, there is shown an embodiment identical to FIG. 1 as described above, except that the bulb segment above hole 38 that forms link 39, is also flattened to form a continuous flattened bulb segment 37 from segments 37*a* and 37*b*, and link 39. Such continuous flattened bulb may extend, for instance, for a distance of 3¾' symmetrically along bulb centerline 27*a*, as shown also in the embodiment of FIG. 1. Link 39 is cut out as shown in FIG. 13 in the same manner as shown in FIG. 3.

The bends made with the embodiments of FIGS. 1 and 12 are identical.

An uncut beam having the configuration of FIG. 12 is not as rigid as the beam having the configuration of FIG. 1, since the unflattened link aids rigidity.

There is shown in FIG. 14 a soffit 23 having a bend 26 formed through a 270° reflex angle. The link 39 is cut out in the same way as set forth above, and as seen in FIG. 15. A brace 50, as seen in FIG. 16, is applied with self-tapping screws after the beam 22 is bent to the desired angle, which, in the embodiment shown, is 270°. The brace 50 is preformed to the desired reflex angle, with suitable screw holes. The brace 50 fixes the bent beam 22 at the desired angle with self-tapping screws. The beam framework with such bent beams 22 is suspended from a structural ceiling 57, as shown in FIG. 14.

What is claimed is:

1. In a straight beam for a suspended ceiling, having an inverted T cross section, with a bulb at the top, a vertical web depending downward from the bulb, opposite extending flanges at the bottom of the web, a removable link in the bulb, and a hole in the web below the link; the improvement comprising a beam, with the link removed, formed into a fixed bend with (1) bulb segments and web portions that overlap each other;

(2) means for avoiding interference between such segments and portions in making the bend, and (3) screw means that extend through such segments and portions to fix the bend.

2. The beam of claim 1, in combination with beams having identical fixed bends, that form a grid for a ceiling soffit having drywall secured to the grid.

3. The beam of claim 1, wherein a bending score is formed in each flange to retain the bend at the score.

4. The beam of claim 1 wherein the overlapped web portions and bulb segments on one side of the bend are forced off center in the bend, so there is no interference with the overlapped web portions and bulb segments on the other side of the bend, which remain centered.

5. The beam of claim 4, wherein bulb segments on both sides of the bend are flattened.

6. The beam of claim 5, wherein a stiffener is formed in one of the bulb segments.

* * * * *